United States Patent [19]

Hanser

[11] 4,380,258

[45] Apr. 19, 1983

[54] LOG SPLITTER

[75] Inventor: Paul E. Hanser, Wilton, Iowa

[73] Assignee: HWH Corporation, Moscow, Iowa

[21] Appl. No.: 252,652

[22] Filed: Apr. 9, 1981

[51] Int. Cl.[3] ..... B27L 7/00

[52] U.S. Cl. ..... 144/193 A

[58] Field of Search ..... 144/193 A, 193 R, 3 K

[56] References Cited

U.S. PATENT DOCUMENTS 2,603,255 7/1952 Woolery ..... 144/193 A 4,019,549 4/1977 Williams ..... 144/193 A

*Primary Examiner*—W. D. Bray

*Attorney, Agent, or Firm*—Henderson & Sturm

[57] ABSTRACT

A log splitter having a base structure on which are mounted two lever arms pivoted together in tong or pincer fashion. The arms are interconnected by a two-way hydraulic cylinder and piston assembly which, when extended, moves the free ends of the arms apart to receive a log endwise between them. The end of one arm has a stop or anvil and the alined end of the other arm has a splitter blade directed toward the anvil so that, when the cylinder is retracted, the splitter blade splits the log. The arrangement features the mounting of the arms and cylinder and piston assembly as a unit for selective angular positioning about the lengthwise axis of the cylinder. Also, the unit is carried on the base structure by an elevator assembly for selective vertical positioning, preferably by a second cylinder and piston unit. Valve means are conveniently provided for controlling the cylinders. Fluid lines lead from the valve means to a power source, such as an internal-combustion engine and hydraulic pump, which may be positioned remotely from the apparatus so as to minimize noise. Portability of the apparatus is another feature.

8 Claims, 11 Drawing Figures

LOG SPLITTER

SUMMARY OF THE INVENTION

One form of known log splitter comprises a frame forming a bed or slide on which a log is placed, with one end of the log abutting a stop. A hydraulic cylinder is disposed at the end of the frame opposite to the stop, and its piston, equipped at its free end with a splitter blade, is advanced to split the log and retracted to make room for another log. It is also known to provide such splitter as a portable unit, commonly in the form of a wheeled trailer that may be towed by a vehicle, such as a pick-up truck. Another similar form of splitter is mounted on the three-point hitch of a typical farm tractor. It is also known to use the remote cylinder of the tractor to activate the splitter blade. One disadvantage of such known splitter is that the logs, sometimes relatively heavy, have to be lifted into place and the split portions that do not fall off the frame must be manually returned to the ground, stack, etc. In the case of a log of relatively large diameter where more than one split is required, the part of the log to be split again must be manually manipulated into place for the next split.

According to the present invention, the pivoted lever arm arrangement enables splitting of the log while it lies on the ground. The ability of the present splitter to achieve various angular positions enables the successive splitting of a log with a minimum amount of manual handling of the log. The vertical positionability of the present splitter permits elevation or lowering of the splitter blade to accommodate logs of various diameters. A splitter constructed according to a preferred embodiment of the present invention is sturdy, relatively inexpensive and features ease of operation and flexibility in use. The hydraulic motor for changing the elevation of the splitter is housed within a telescopic assembly rising from the base structure. One of the arms is conveniently carried on cross-wise trunions on the splitter motor, which eliminates costly special mounting means and at the same time provides for the unitary arrangement of the pair of arms and the splitter motor for angular and vertical positioning.

In a modified form of the invention, the wheeled axis is different in that the axle parallels the main cylinder and the ground-engaging wheels are therefore transverse to the cylinder, which facilitates maneuverability of the unit without dragging the end of the cylinder over the ground. The axle is furthermore of a telescopic nature so that the tread of the wheels can be narrowed for transport and extended for operational stability.

DETAILED DESCRIPTION OF A PREFERRED EMBODIMENT OF THE INVENTION

Figure 2:
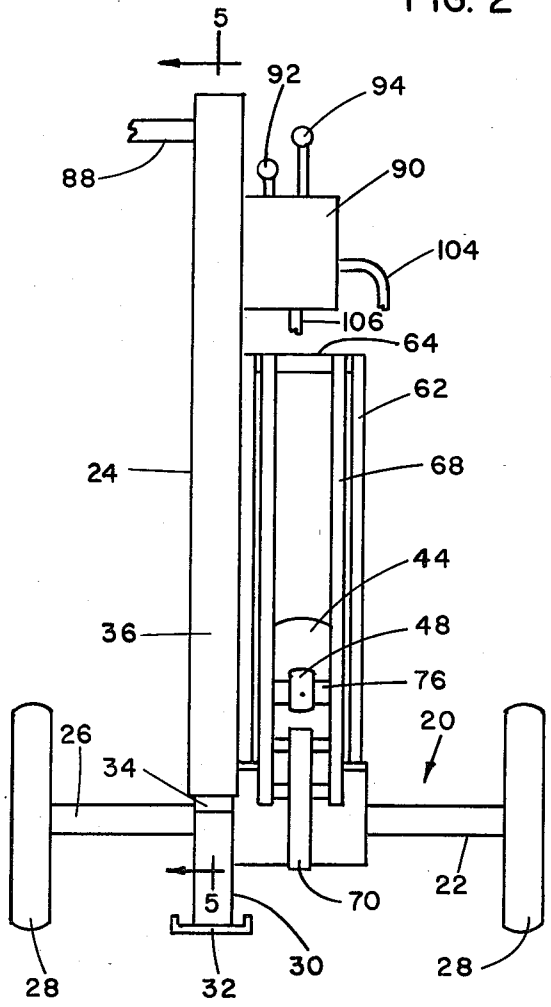
FIG. 2 is an end view of the structure shown in FIG. 1.

The numeral 20 designates in its entirety a base structure made up of a bottom part 22 and an elevator part 24. The bottom part, in one form of the invention, includes an axle 26 having wheels 28 at its opposite ends, a brace 30 having a ground-engaging foot 32 and a rigid tubular mast 34. The mast, axle, brace and foot are preferably assembled and welded together as a rigid unit from selected tubular steel stock.

Figure 5:
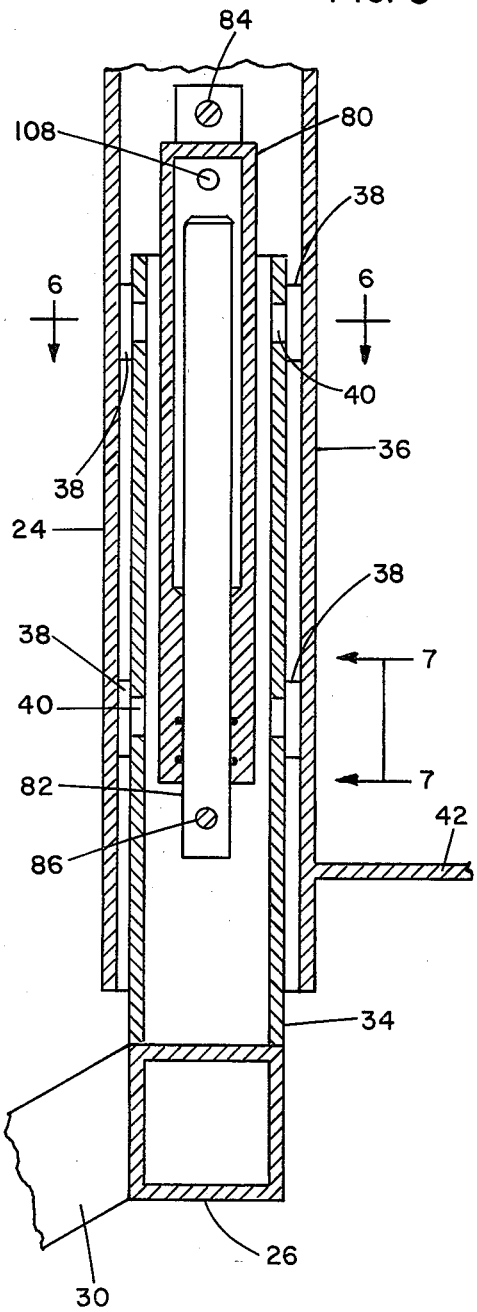
FIG. 5 is a section of the mast and elevator assembly for raising and lowering the splitter and motor unit, as seen along the line 5—5 of FIG. 2.
Figure 6:
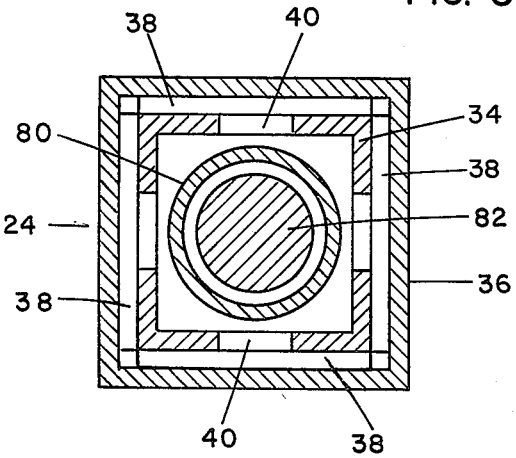
FIG. 6 is a section as seen on the line 6—6 of FIG. 5.
Figure 7:
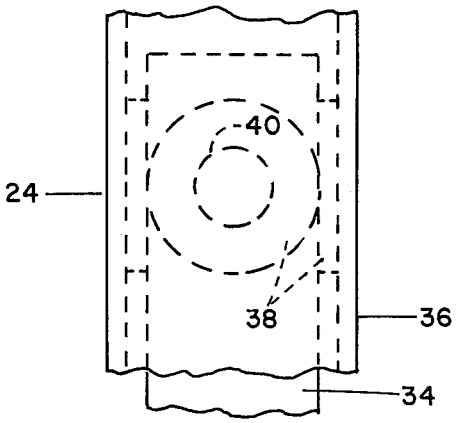
FIG. 7 is a fragmentary elevation as seen along the line 7—7 of FIG. 5.

A elevator member 36 in the form of a steel tube of square cross section is telescoped over the mast and is guided on the mast by means of bearings, here a plurality of sets of slides 38, which may be of Nylon or other suitable material. These are best shown in FIGS. 5, 6 and 7. Each slide is circular and has a reduced-diameter, circular hub 40 received in an appropriate circular opening in the mast. As seen in FIG. 5, there are upper and lower sets of slides and each set includes four slides. The slides are assembled into their mast openings before the elevator tube is put in place. The slide hubs have relative tight fits with the mast openings and do not become dislodged when the elevator tube is assembled over the mast. Because of the vertical locations of the slides and the amount of relative vertical movement of the elevator tube (as will appear subsequently herein), the slides cannot fall out during operation of the apparatus.

Figure 1:
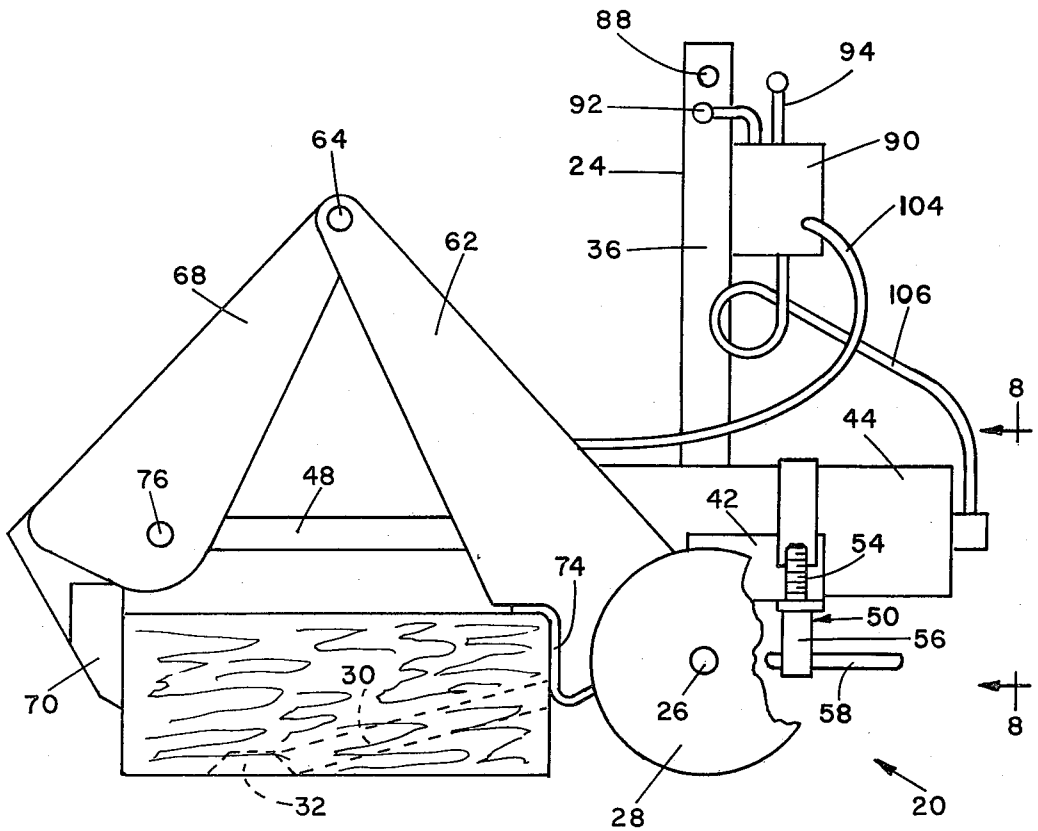
FIG. 1 is a side elevation of the splitter, a portion of one wheel being broken away to show the splitter motor mounting.
Figure 8:
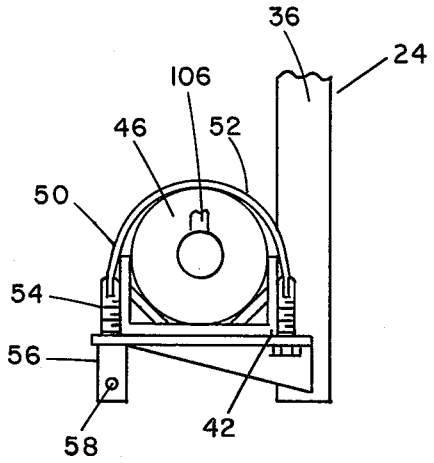
FIG. 8 is an end view as seen along the line 8—8 of FIG. 1.

The mast has rigidly secured to a lower portion thereof, as by welding, a saddle or like means 42 for mounting a two-way hydraulic splitter motor comprising a cylinder 44, a piston 46 and a piston rod 48. The cylinder is disposed in the saddle with its lengthwise axis normal to the axle 22 and is secured in place by clamp means 50 (FIGS. 1 and 8). The clamp means includes a semi-circular band 52 secured at one end to the saddle and having a threaded portion 54 at its other end passing through the bottom of the saddle and receiving a nut 56 provided with a handle 58. The clamp means may be selectively loosened or released to enable angular positioning of the cylinder about its lengthwise axis and tightened or locked to secure or lock the cylinder in the position chosen.

Figure 3:
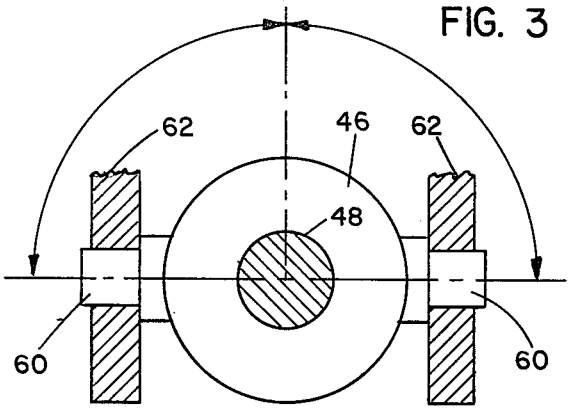
FIG. 3 is an enlarged cross-sectional view showing the trunnion mounting of one arm on the splitter motor.
Figure 4:
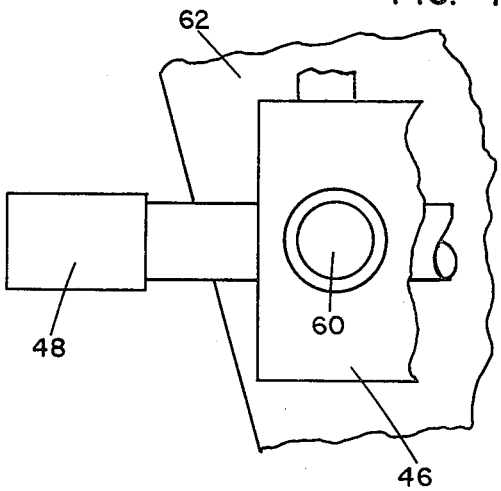
FIG. 4 is an elevation of the structure shown in FIG. 3, the near portion of the mounted arm being omitted to show the trunnion.

As best seen in FIGS. 1, 3 and 4, the piston extends out of the cylinder in what is here regarded as a forward position. The forward end of the cylinder is provided with a pair of rigid trunnions 60, respectively at diametrically opposed sides of the cylinder and coaxial on an axis cross-wise to the length of the cylinder. These trunnions serve as part of the means for mounting on the base structure a first lever arm 62. For purposes of strength and ease of manufacture, the lever arm is a doubled, welded structure, but, for purposes of the present disclosure will be referred to in the singular. This lever arm is pivoted at its lower end portion on the trunnions 60 and rises therefrom (in the position shown here) to an upper end, at which point it has pivot means 64 for mounting the upper end of a second lever arm 68, here again a doubled and welded structural member again referred to in the singular. The lower end portion of the arm 68 has rigid thereon a splitter blade 70 which faces or is directed toward a stop, abutment means or anvil 74 rigidly mounted at the lower end of the other arm 62. The piston rod of the splitter motor is pivotally connected to the arm 68 at 76, just above the splitter blade. Because of the pivotal connections at 60, 64 and 76, the movement of the splitter blade is linear, which is consistent with the movement of the splitter piston and piston rod, since the cylinder 44, when locked by the clamp means, is immobilized. When the piston rod is extended (FIG. 1), the splitter blade and anvil are spaced apart so as to receive a log between them. When fluid pressure is applied to the rod end of the cylinder, the splitter blade moves toward the anvil to split the log. The same result obtains regardless of the angular position of the arms and splitter motor as a unit as respects the axis of the splitter motor. The range of movement is indicated by arrows in FIG. 3. In a board sense, and considering the base structure as a unit and the splitter motor and lever arms 62 and 68 as another unit, the clamp means and trunnions serve as means for connecting the unit 44, 62, 68 to the base structure unit.

As noted earlier herein, the splitter unit can be raised and lowered relative to the base structure bottom as the elevator tube slides up and down on the mast 34. This action is effected by a second hydraulic motor, here of the one-way type, comprising an elevator cylinder 80 and piston rod 82, the latter being of the type in which its cylinder-enclosed end serves as the piston (FIG. 5). The closed end of the cylinder is pinned at 84 to the upper end portion of the elevator tube and the free end of the piston rod is pinned at 86 to a lower portion of the mast. Thus, extension of the cylinder-piston unit raises the elevator tube, along with the splitter motor and arms 62 and 68, relative to the bottom or ground-supported part 22 of the base structure 20. Exhaustion of fluid pressure from the cylinder 80 allows the elevator tube and its parts to descend by gravity. During any vertical position of the elevator tube, angular movement is possible and this is made easier by the provision of a handle means 88 at the upper end portion of the elevator tube (FIGS. 1 and 2).

Figure 9:
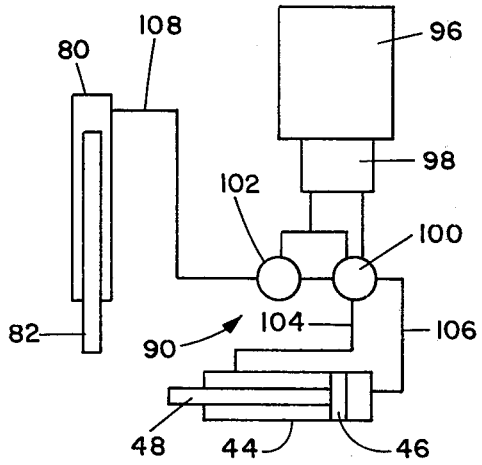
FIG. 9 is a schematic view showing one form of engine-driven hydraulic system.

Conveniently located relative to the handle means is a control box or dual valve unit 90, suitably mounted on one side of the upper part of the elevator tube. Extending from this unit is a handle or lever 92 for operation of the elevator motor and a second handle 94 for operation of the splitter motor. FIG. 9 is a representative schematic of an engine-powered hydraulic system, comprising, in part, an internal-combustion engine 96. The engine drives a typical hydraulic pump 98 which delivers fluid under pressure to the control box or unit 90, which here houses in any suitable manner a splitter valve 100 and an elevator valve 102. The splitter valve, by means of the lever 94, selectively directs fluid under pressure to opposite ends of the splitter motor via fluid lines 104 and 106. The elevator valve 102 controls fluid pressure to and from the elevator motor via a single line 108. Since the line 108 leads to the elevator cylinder via an appropriate opening (not shown) in the elevator tube, the flexibility inherent in the line accommodates up and down movement of the elevator tube.

Regardless of the angular or vertical positions of the splitter unit relative to the bottom unit, adequate stability is achieved by the three-point support on the ground via the wheels 28 and foot 32, together with the rigidity afforded by the elevator and mast assembly. The embodiment of the invention disclosed here is a relatively lightweight model and can be easily moved by manual effort. Obviously, heavier versions could be provided, with larger and heavy-duty wheels in place of the wheels 28 and with a draft tongue (not shown) for hitching to a towing vehicle, such as a pick-up truck.

Figure 11:
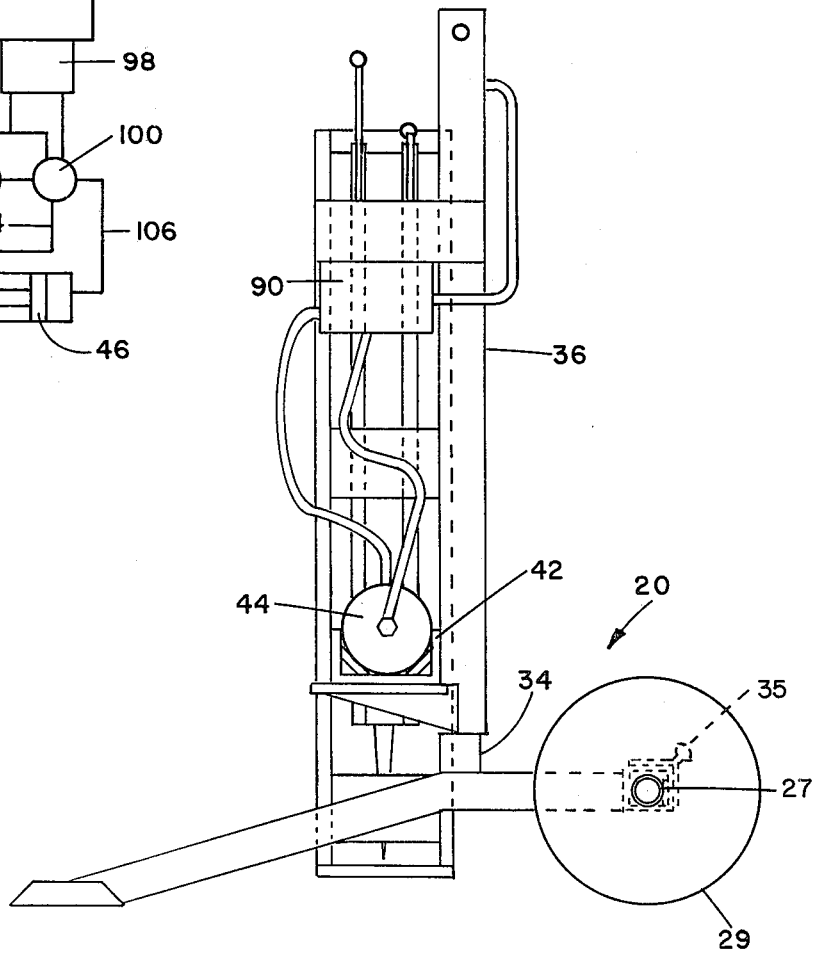
FIG. 11 is an end view of the unit shown in FIG. 10.
Figure 10:
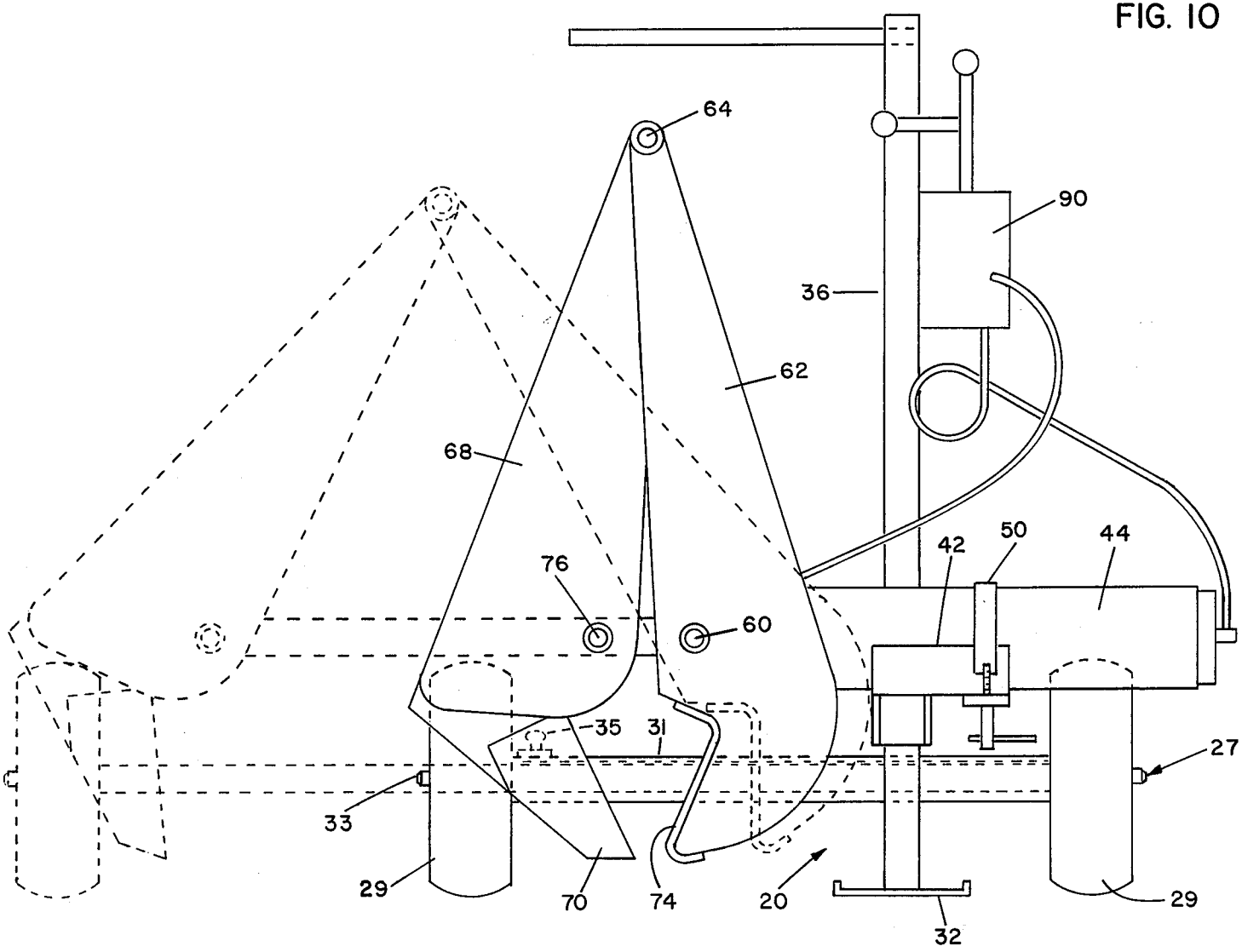
FIG. 10 is an elevation of a modified form of unit in which the wheeled axle is parallel to the length of the main cylinder.

The modified form of unit shown in FIGS. 10 and 11 is basically the same as that described and the fundamental parts have been numbered according to those previously described but will not themselves be specifically referred to. For example, the base or bottom unit will be recognized at 20, the splitter motor at 44, the lever arms at 62 and 68, etc. The difference exists in the axle arrangement, here parallel to the length of the splitter cylinder. The axle is designated in its entirety at 27 and has wheels 29 at its opposite ends. The axle comprises two telescopic parts 31 and 33 and, as shown in full lines in FIG. 10, can be shortened to narrow the wheel tread during transport of the unit or can be extended to increase the tread for operational stability, as seen in the dotted-line position in FIG. 10. A suitable releasable means 35 is provided for fixing the telescopic parts in selected positions. Components common to both forms of the invention will be recognized without further description and reference numerals, and the operation of the two forms does not vary in fundamental aspects except for advantages accruing in each case because of the type of wheeled support.

I claim:

1. A log splitter, comprising: a base structure, a two-way hydraulic splitter motor having a cylinder, piston and piston rod and disposed adjacent to the base structure with the lengthwise axis of the cylinder generally horizontal and the piston rod projecting away from the base structure, a first arm having a lower end adjacent to the base structure and rising to an upper end at an elevation above that of the base structure, pivot means connecting the first arm lower end to the cylinder on a generally horizontal axis transverse to the cylinder axis, a second arm having an upper end adjacent to the first arm upper end and a lower end generally horizontally alined with the first arm lower end, means pivotally interconnecting the upper ends of the arms on an axis parallel to that of the aforesaid pivot means, means mounting the cylinder on the base structure and fixing it against movement along its axis, said means including clamp means selectively releasable and lockable to enable angular positioning of the cylinder and arms as a unit about the cylinder axis and relative to the base structure, stop means at the lower end of the first arm and facing the lower end of the second arm, a splitter blade on the lower end of the second arm and directed toward the stop means, means connecting the free end of the piston rod to the second arm, and fluid line means connected to the cylinder for extending the piston to space the splitter blade away from the stop means and for retracting the piston to move the blade toward the stop means for splitting a log received between the blade and stop means while the piston is extended.

2. The log splitter of claim 1, characterized in that the means mounting the lower end of the first arm comprises a connection directly between the cylinder and said lower end, the base structure includes a bottom member adapted to be supported on the ground or the like, a mast rigid with the bottom member, an elevator member disposed adjacent to the mast, and means mounting the elevator member on the mast for relative vertical movement, the means mounting the cylinder on the base structure includes the elevator member for carrying the cylinder and arms as a unit directly on the elevator member separate from the bottom member and mast, and means is provided for acting between the elevator member and mast for effecting vertical movement of the elevator member and its associated cylinder and arms.

3. The log splitter of claim 2, further characterized in that the last-named means includes a second hydraulic motor.

4. The log splitter of claim 3, further characterized in that the mast and elevator member are of hollow cross-section, the elevator member is telescopically received over the mast, and the second hydraulic motor is enclosed within the mast and elevator member.

5. The log splitter of claim 4, further characterized in that first valve means is carried by the elevator member for controlling the splitter motor and second valve means is carried by the elevator for controlling the second motor.

6. A log splitter, comprising: a base structure, including a bottom member adapted to be supported on the ground or the like, a mast rigid with the bottom member, an elevator member mounted on the mast for relative vertical movement, a two-way hydraulic splitter motor having a cylinder, piston and piston rod and disposed adjacent to the bottom member with the lengthwise axis of the cylinder generally horizontal and the piston rod projecting away from the base structure, a first arm having a lower end adjacent to the base structure and rising to an upper end at an elevation above that of the base structure, pivot means connecting the first arm lower end to the cylinder on a generally horizontal axis transverse to the cylinder axis, a second arm having an upper end adjacent to the first arm upper end and a lower end generally horizontally alined with the first arm lower end, means pivotally interconnecting the upper ends of the arms on an axis parallel to that of the aforesaid pivot means, means mounting the cylinder on the elevator member for vertical movement of the cylinder and arms with the elevator member, stop means at the lower end of the first arm and facing the lower end of the second arm, a splitter blade on the lower end of the second arm and directed toward the stop means, means connecting the free end of the piston rod to the second arm, and fluid line means connected to the cylinder for extending the piston to space the splitter blade away from the stop means and for retracting the piston to move the blade toward the stop means for splitting a log received between the blade and stop means while the piston is extended and means acting between the mast and elevator member for effecting the aforesaid vertical movement said mast and said elevator member being of hollow cross-section, said elevator member being telescopically received over said mast, said means acting between the mast and elevator member being enclosed therein.

7. The log splitter of claim 6, further characterized in that the last-named means includes a second hydraulic motor.

8. The log splitter of claim 7, further characterized in that first valve means is carried by the elevator member for controlling the splitter motor and second valve means is carried by the elevator for controlling the second motor.

* * * * *